US007487607B2

(12) United States Patent
Bonesteel

(10) Patent No.: US 7,487,607 B2
(45) Date of Patent: Feb. 10, 2009

(54) HEATING SYSTEM FOR HYDRAULIC FLUID

(76) Inventor: Brian Bonesteel, 300 Main St., Kingston, NY (US) 12401

( * ) Notice: Subject to any disclaimer, the term of this patent is extended or adjusted under 35 U.S.C. 154(b) by 252 days.

(21) Appl. No.: 11/137,879

(22) Filed: May 26, 2005

(65) Prior Publication Data

US 2006/0265912 A1 Nov. 30, 2006

(51) Int. Cl.
*E01H 5/04* (2006.01)

(52) U.S. Cl. ..... 37/234; 37/227; 37/236

(58) Field of Classification Search ..... 37/234, 37/348, 382, 414–416, 902, 227, 236, 235
See application file for complete search history.

(56) References Cited

U.S. PATENT DOCUMENTS

| | | | | | |
|---|---|---|---|---|---|
| 3,793,752 | A * | 2/1974 | Snyder | 37/234 |
| 3,828,875 | A | 8/1974 | Tarter | |
| 3,969,835 | A * | 7/1976 | Erdelyan | 37/414 |
| 4,028,820 | A | 6/1977 | Simmonds, Jr. | |
| 4,279,084 | A * | 7/1981 | Low et al. | 37/236 |
| 4,310,198 | A | 1/1982 | Destree | |
| 4,370,956 | A | 2/1983 | Moser et al. | |
| 4,526,413 | A * | 7/1985 | Williams | 294/88 |
| 4,813,165 | A * | 3/1989 | Pelazza | 37/228 |
| 5,265,356 | A * | 11/1993 | Winter | 37/234 |
| 5,600,954 | A * | 2/1997 | Bay et al. | 60/454 |
| 5,802,745 | A * | 9/1998 | Haseotes et al. | 37/234 |
| 5,832,637 | A | 11/1998 | Aguado et al. | |
| 5,971,503 | A * | 10/1999 | Joyce et al. | 303/191 |
| 6,062,809 | A * | 5/2000 | Berkey et al. | 414/809 |
| 6,099,325 | A * | 8/2000 | Parkhill | 439/76.1 |
| 6,132,184 | A * | 10/2000 | Robertson et al. | 417/410.3 |
| 6,922,925 | B2 * | 8/2005 | Watanabe et al. | 37/466 |

* cited by examiner

*Primary Examiner*—Thomas A Beach

(57) ABSTRACT

A Heating System is provided for heating the hydraulic fluid of a hydraulic unit used with a power source and having a reservoir for retaining hydraulic fluid. The heating system comprises a heating element located in the reservoir. A switch is included along with a power line for connecting the power source to the switch. An electrical line is connected to the switch and is connected to the power line when the switch is closed. A relay is connected to the electrical line. A return line is connected to the relay and to the power source and a heater line connected to the relay and to the heater.

4 Claims, 2 Drawing Sheets

HEATING SYSTEM FOR HYDRAULIC FLUID

BACKGROUND OF THE INVENTION

1. Field of the Invention

This Invention relates to heating systems and, more specifically, to a heating system for heating hydraulic fluid such as used to operate a snow plow.

2. Prior Art

The use of snow plows on vehicles is comon place in areas which have snow. Snow plows, regardless of manufacture, must be raised and lowered from and to the ground and also be turned to the right and to the left. Pistons and cylinders are used for these purposes and the pistons and cylinders are activated by hydraulic fluid pumped into them under pressure. The pumps can be activated by the vehicle engine but, in the more recent designs, the pump is powered by an electric motor.

The hydraulic system for snow plows is not a closed circuit but rather draws hydraulic fluid from a reservoir and returns the hydraulic fluid to the reservoir as required to operate the plow. Hydraulic fluid is pumped out of the reservoir while air is drawn into the reservoir. Obviously, in cold and snowy weather, the air is moist and moisture forms in the reservoir. That moisture ultimately freezes forming ice in the reservoir. The ice blocks the hydraulic system making the snow plow inoperative. At that point, the vehicle on which the snow plow is mounted must be placed in a heated garage to allow the ice to melt and the moisture to be drawn off the reservoir. Such a delay in the ability to provide plowing services results in customer dissatisfaction and financial loss to the snow plow operator.

OBJECTS

The objects of this invention are as follows:

1. To provide a heating system for a hydraulic unit that is dependable and safe.

2. To provide a heating system for a hydraulic unit that is economical.

3. To provide a heating system for a hydraulic unit that can easily be installed on an existing hydraulic unit.

4. To provide a heating system for a hydraulic unit that has an operating level of heat input and a booster level of heat input to prevent ice form forming and to thaw ice that has formed in a hydraulic unit.

5. To provide a heating system for heating hydraulic fluid that is avoids boiling of the hydraulic fluid.

SUMMARY OF THE INVENTION

A Heating System is provided for heating the hydraulic fluid of a hydraulic unit used with a power source. The hydraulic unit includes a reservoir for retaining hydraulic fluid. A heating element is located in the reservoir and electrical means are provided for connecting the heating element or heater to the power source and activating and deactivating the heating element.

Figure 2:
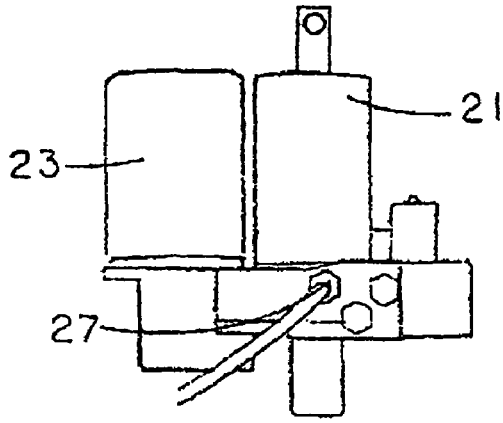
FIG. 2 is a front elevation of a reservoir for a hydraulic fluid with a pump and motor made by a different manufacturer than that shown in FIG. 1[1]

[1] The reservoir and pump and motor shown in FIG. 2 is a product of Meyers.

Figure 3:
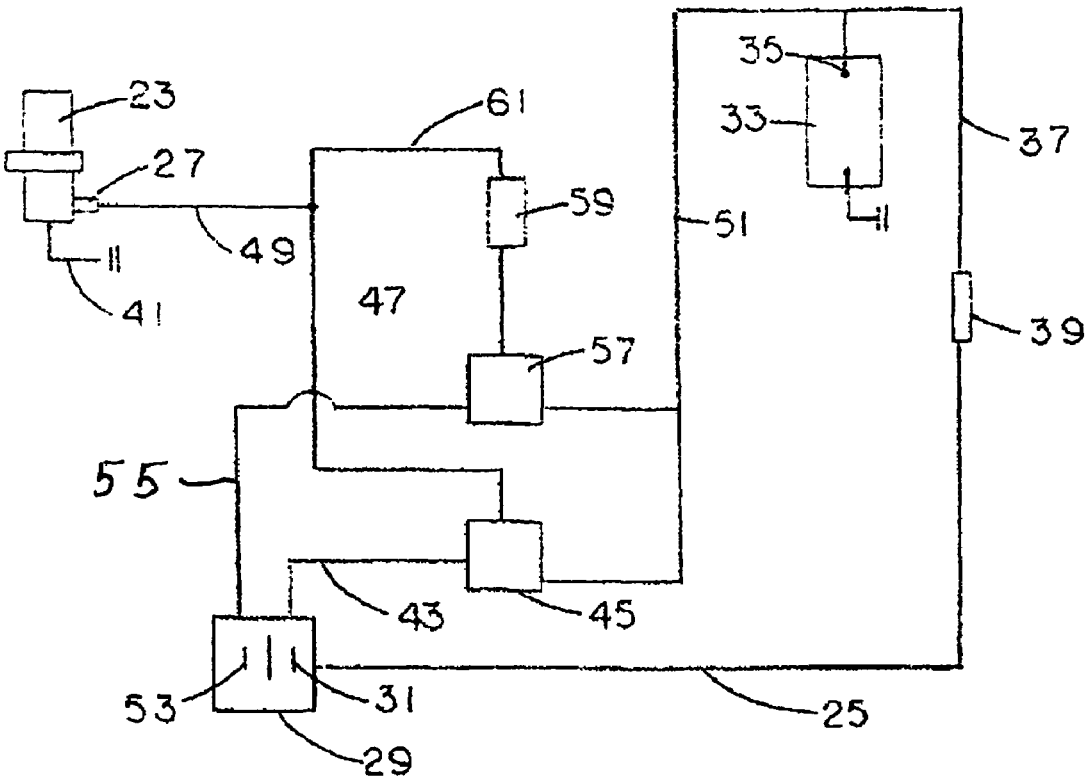

FIG. 3 is en electric schematic of the heating system.

BRIEF DESCRIPTION OF THE NUMERALS

| NUMERAL | DESCRIPTION |
|---|---|
| 11 | Snow Plow |
| 13 | Vehicle |
| 15 | Blade |
| 17 | Mounting Bracket |
| 19 | Hydraulic Unit |
| 21 | Reservoir |
| 23 | Motor and Pump |
| 25 | Electric Circuit |
| 27 | Heating Element |
| 29 | Switch |
| 31 | Boost Position |
| 33 | Battery |
| 35 | Positive Terminal |
| 37 | Power Line |
| 39 | Fuse |
| 41 | Ground |
| 43 | Booster Line |
| 45 | Booster Relay |
| 47 | Booster Heater Line |
| 49 | Heater Line |
| 51 | Battery Line |
| 53 | Operating Position |
| 55 | Operating Line |
| 57 | Operating Relay |
| 59 | Resistor |
| 61 | Operating Heater Line |

DETAILED DESCRIPTION OF THE PREFERRED EMBODIMENT

Figure 1:
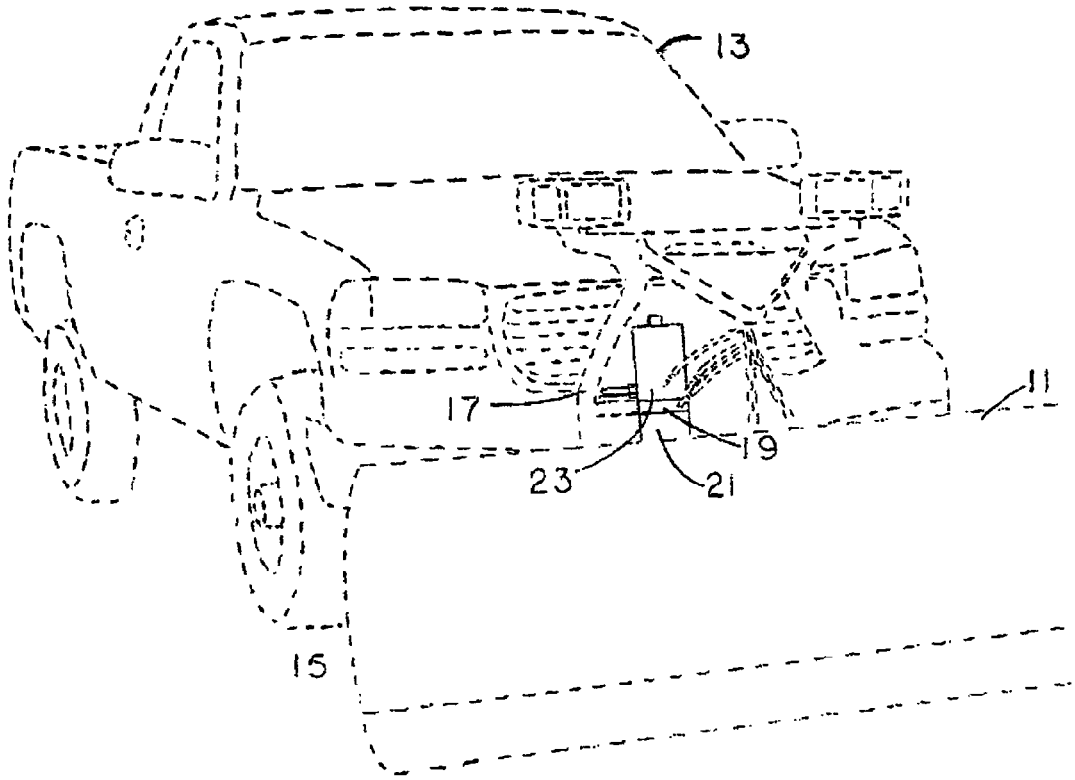
FIG. 1 is a pictorial view of a vehicle with a snow plow mounted on it showing the reservoir above and directly to the rear of the blade of a snow plow.

Referring now to FIG. 1, a snowplow 11 is shown mounted on a vehicle 13, namely a pickup truck. The snow plow 11 includes a blade 15 and a mounting bracket 17 as well as a hydraulic unit 19. Included in the hydraulic unit 19 is a reservoir 21 which is mounted directly behind and above the blade 15. The reservoir 21 is used for retaining hydraulic fluid to supply hydraulic fluid to the hydraulic unit 19. With the design shown in FIG. 1, a motor and pump are located above the reservoir.[1]

[1] The snowplow shown in FIG. 1 is a product of Fisher,

The placement of the reservoir 21 above the blade 15 and directly behind the blade 15, exposes the reservoir 21 to snow and moisture when the snowplow 11 is in use. The reservoir 21 is open to the atmosphere and, as hydraulic fluid is pumped out of the reservoir 21 by the motor and pump 23, air is drawn into the reservoir 21 along with moisture. During snow conditions, the moisture freezes producing ice that disables the snowplow 11.

In FIG. 2, a reservoir 21 is shown having a different design from that shown in FIG. 1[2]. Once again, a motor and pump 23 forces hydraulic fluid from a reservoir 21 into the hydraulic unit 19. The heating element 27 is installed in an opening, possibly an existing drain opening, in the reservoir. To retain the drain opening, as such, it is necessary to drill and tap a separate opening just for the heating element 27. Regardless of the manufacturer of the snowplow, the operation of the snowplow draws moisture into the reservoir whenever hydraulic fluid is pumped out.

[2] The reservoir with motor and pump shown in FIG. 2 is a product of Meyers As best seen in FIG. 3, an electric circuit 25 is provided to activate the heating element 27 mounted in the reservoir 21. The Heating System has two levels of heat, namely, a booster level which is used to thaw ice already formed in the reservoir 21 and a operating level used to prevent ice from forming in the reservoir 21. It should be noted that neither the booster level nor the operating level will cause the hydraulic fluid in the hydraulic unit 19 to boil. The heating element 27 must be sized to provide sufficient heat to thaw the ice and to prevent ice from forming in the reservoir 21 while remaining below a temperature at which the hydraulic fluid would boil.

A switch 29 having three positions serves to turn the Heating System on and off and also to select the level of heat input. The middle position of the switch is preferable the off position. By pushing the switch 29 downwardly, preferably the boost position 31 is activated. To avoid leaving the Heating System at the boost position 31, the switch 29 preferably requires hat it be held in that position. Whether the lower position or the upper position of the switch 29 is used for the boost position 31 is not important. Similarly, a switch 29 with a right and a left position may be used in place of an upper and lower position.

The battery 33, usually the battery of the vehicle 13, is located in the electric circuit 25 and power from the positive terminal 35 of the battery 33 is supplied through a power line 37 to the switch 29. A fuse 39 is located in the power line 37. The heating element 27 is also connected to the ground 41. Power passes through the switch 29 to a booster line 43 which connects to a booster relay 45 and from the booster relay 45 to the heating element 27 through a booster heater line 47 that connects to a heater line 49 which is connected to the heating element 27. The booster relay 45 is also connected to the battery 33 by a battery line 51 to complete the electric circuit 25. With the switch 29 placed in the operating position 53, opposite from the booster position 31, the electric circuit 25 is activated as to the operating position 53. As with the booster position 31, power is supplied from the battery 33 to the switch 29 through the power line 37. Power passing through the switch 29 in the operating position 53 is conveyed by an operating line 55 to an operating relay 57 and through the battery line 51 to the battery 33. From the operating relay 57, power flows through a resistor 59 in an operating heater line 61 to the heater line 49 connected to the heating element 27.

The booster position 31 and the operating position 53 are essentially the same with the exception that in the operating position 53, a resistor 59 lowers the power supplied to the heating element 27.

It is to be understood that the drawings and description matter are in all cases to be interpreted as merely illustrative of the principles of the invention, rather than as limiting the same in any way, since it is contemplated that various elements to achieve like results without departing from the spirit of the invention or the scope of the appended claims.

The invention claimed is:

1. A heating system for heating the hydraulic fluid of a hydraulic unit used with a power source and having a reservoir for retaining hydraulic fluid, the heating system comprising:

a heating element located in the reservoir;

a switch having an off position, a booster position and an operating position;

a power line for connecting the power source to the sch;

a booster line connected to the switch and being connected to the power line with the switch in the booster position;

a booster relay connected to the booster line;

a return line connected to the relay and to the power source; and a booster heater line connected to the booster relay and to the heating element;

an operating line connected to the switch and being connected to the power line with the switch in the operating position;

an operating relay connected to the operating line, the operating relay being connected to the return line; and an operating heater line connected to the operating relay and to the heating element, a resistor being located in the operating heating line between the operating relay and the heating element.

2. The heating system according to claim 1 wherein one of the two levels of heat is a booster level to thaw ice already formed in the reservoir.

3. The heating system according to claim 1 wherein one of the two levels of heat is an operating level to prevent ice from forming in the reservoir.

4. The Heating System according to claim 1 wherein:

one of the two levels of heat is a booster level to thaw ice already formed in the reservoir; and wherein the other of the two levels of heat is an operating level to prevent ice from forming in the reservoir.

* * * * *